US007056239B2

(12) United States Patent
Hickman, Jr.

(10) Patent No.: US 7,056,239 B2
(45) Date of Patent: Jun. 6, 2006

(54) THROWING AND CATCHING TRAINING APPARATUS

(76) Inventor: Henry Hickman, Jr., G-2112 S. Center, Burton, MI (US) 48519

( * ) Notice: Subject to any disclaimer, the term of this patent is extended or adjusted under 35 U.S.C. 154(b) by 0 days.

(21) Appl. No.: 10/727,897

(22) Filed: Dec. 4, 2003

(65) Prior Publication Data

US 2005/0181894 A1 Aug. 18, 2005

(51) Int. Cl.
*A63B 69/00* (2006.01)

(52) U.S. Cl. ..... 473/454; 473/434; 473/422

(58) Field of Classification Search ..... 473/422, 473/421, 434, 435, 536, 454–456, 197; 273/398–404, 273/410
See application file for complete search history.

(56) References Cited

U.S. PATENT DOCUMENTS

| | | | | | |
|---|---|---|---|---|---|
| 2,254,986 | A | * | 9/1941 | Ziel | 473/454 |
| 3,697,068 | A | * | 10/1972 | McDougall | 473/434 |
| 3,968,967 | A | * | 7/1976 | Nally | 473/423 |
| 4,026,551 | A | * | 5/1977 | Larson | 473/454 |
| 4,134,585 | A | * | 1/1979 | Semon | 473/434 |
| 4,364,562 | A | | 12/1982 | White et al. | |
| 4,497,485 | A | | 2/1985 | Macosko | |
| 4,872,674 | A | | 10/1989 | Deal | |
| 4,913,427 | A | | 4/1990 | Wilson | |
| 5,007,638 | A | * | 4/1991 | Yukl | 473/435 |
| 5,083,774 | A | | 1/1992 | Yalvac | |
| 5,238,243 | A | * | 8/1993 | Grispi | 473/446 |
| 5,332,230 | A | * | 7/1994 | Benedict | 473/594 |
| 5,333,856 | A | * | 8/1994 | Gery | 473/454 |
| 5,354,051 | A | | 10/1994 | Fehrenbach et al. | |
| 5,465,958 | A | * | 11/1995 | Brun | 473/426 |
| 5,622,369 | A | * | 4/1997 | Rogers | 273/398 |
| 5,795,250 | A | * | 8/1998 | Cripe | 473/426 |
| 5,934,679 | A | * | 8/1999 | Strain et al. | 273/395 |
| 6,010,414 | A | * | 1/2000 | Snow | 473/422 |
| 6,093,120 | A | | 7/2000 | Luke, Jr. | |
| 6,155,936 | A | | 12/2000 | Dorr | |
| 6,843,478 | B1 | * | 1/2005 | Hoepelman | 273/342 |
| 2004/0023735 | A1 | * | 2/2004 | Janton | 473/434 |

FOREIGN PATENT DOCUMENTS

| | | |
|---|---|---|
| DE | 81 35 417 U1 | 4/1982 |
| WO | WO 84/00497 A | 2/1984 |

* cited by examiner

*Primary Examiner*—Mitra Aryanpour
(74) *Attorney, Agent, or Firm*—Young & Basile, P.C.

(57) ABSTRACT

A throwing and catching training apparatus for sports is disclosed. The throwing and catching training apparatus provides an upright, rigid target panel having a plurality of elastomeric bumpers connected to the target panel wherein the bumpers are adaptable to deflect a thrown projectile in a random direction. A pair of support structures are connected to the target panel for supporting the target panel in an upright position. The target panel may have a cut-out portion extending through the target panel for further defining a target. An elastic mesh netting may be connected to the target panel and extend across the cut-out portion of the target panel in order that a thrown projectile may spring back from the target panel after engaging the elastic mesh netting. The shape of the bumpers allows the thrown projectile to deflect back to the user in a random direction.

6 Claims, 3 Drawing Sheets

THROWING AND CATCHING TRAINING APPARATUS

FIELD OF THE INVENTION

The invention relates generally to sports practice aids, and more particularly, to a throwing and catching training apparatus for sports, such as baseball and softball.

BACKGROUND OF THE INVENTION

Sports utilizing a thrown or struck projectile, such as baseball and softball, have become extremely popular worldwide. As a result, a wide variety of training and practice aids have been developed to improve players' abilities in all aspects of these types of sports.

One popular training aid is a target utilized to develop a player's accuracy in throwing a ball. Both baseball and softball players utilize devices which are designed expressly for the development of throwing accuracy, generally referred to as "pitching targets". Many of these targets are primarily composed of netting or a mesh which is maintained under tension or spring-loading, provide a recoil or rebound of a pitched ball. Many of these targets are primarily designed, however, in such a way that the return angle of a projectile is relatively constant.

While these types of devices meet the needs of developing pitching accuracy, they are deficient, however, in that they neglect the development of fielding techniques. While there have been prior efforts toward developing targets which produce a more random return angle as a thrown baseball or softball rebounds, these devices have been successful in producing only very limited variance in the angles of deflection, particularly vertical deflection. Further, the known devices tend to be predictable in their rebound, providing only limited benefits for training purposes.

Many of the prior art devices also have limitations in that they are relatively complex, consist of a large number of individual components, require substantial assembly and disassembly effort, and are accordingly heavy and unwieldy.

A need exists, therefore, for a new sports training aid which will provide a random rebound to a thrown projectile, wherein the training aid is constructed of as few assembly parts as possible, is easy to set up and break down, and is lightweight and convenient to store.

It would be desirable to provide a sports training aid which would assist in developing fielding techniques, by providing an apparatus for causing a thrown projectile to rebound at random arbitrary angles, simulating the environment in an actual game, wherein the player reacts to the direction of a deflected ball without being able to effectively anticipate in which direction the ball will be deflected.

It would also be desirable to permit more than one user to utilize the training target simultaneously. With randomly generated deflections, more than one user can occupy the space wherein the ball will be returned, further and more closely simulating an actual fielding environment.

SUMMARY OF THE INVENTION

The present invention is a throwing and catching training apparatus for sports, such as baseball and softball. The apparatus includes an upright, substantially rigid target panel. At least one bumper is connected to the target panel and is adaptable to deflect a thrown projectile in a random direction. At least one support structure is connected to the target panel for supporting the target panel in an upright position.

The target panel may have a cut-out portion extending through said target panel for further defining a target. An elastic material is connected to the target panel and extends across the cut-out portion of the target panel. The elastic material is adaptable to spring the thrown projectile in a reverse direction when the thrown projectile engages the elastic material.

The at least one bumper may be fabricated from an elastomeric material and may have a substantially cylindrical stem that is releasably connected to the target panel. A substantially circular, dome-shaped head may be integrally connected to the stem and extend away from the target panel for deflecting the thrown projectile in a random direction.

BRIEF DESCRIPTION OF THE DRAWINGS

The description herein makes reference to the accompanying drawings wherein like referenced numerals refer to like parts throughout several views and wherein.

DETAILED DESCRIPTION OF THE EMBODIMENT

Figure 1:
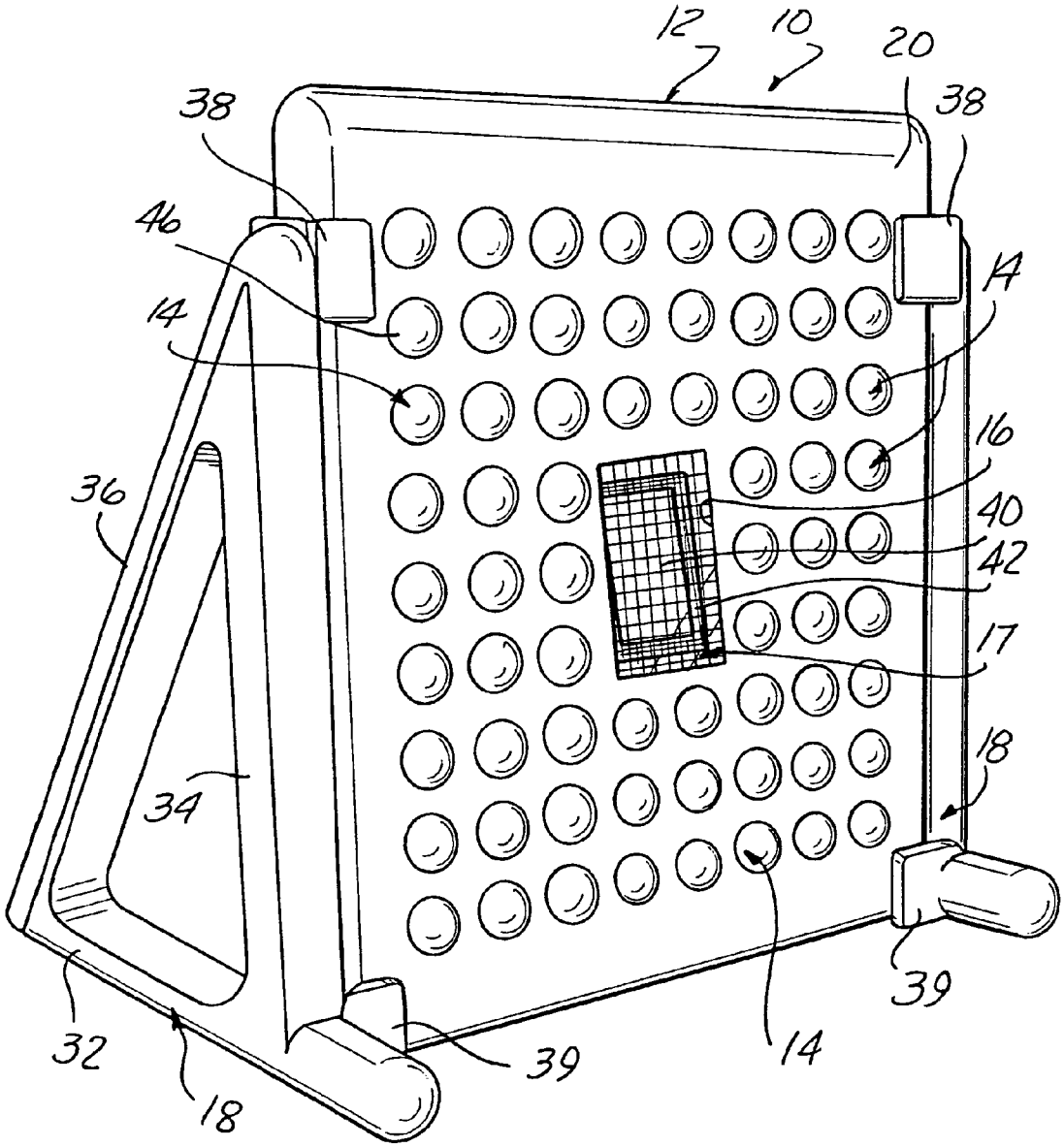
FIG. 1 is a perspective view showing the front of the throwing and catching training apparatus of the present invention.

Referring to the drawings, the present invention will now be described in detail with reference to the disclosed embodiment.

FIGS. 1–4 illustrate a throwing and catching training apparatus 10 for sports, such as baseball and softball. The apparatus 10 provides an upright, substantially rigid target panel 12 having a plurality of elastomeric bumpers 14 releasably connected thereto. The elastomeric bumpers 14 are adaptable to deflect a thrown projectile, such as a baseball or softball (not shown), in a random direction relative to the initial direction of the thrown projectile. The target panel 12 has a cut-out portion or window 16 that extends through the target panel 12 for further defining a target. An elastomeric material 17 is connected to the target panel 12 and extends across the cut-out portion 16 to spring the thrown projectile back in the direction in which the projectile was thrown when the thrown projectile engages the elastomeric material 17. A pair of support structures 18 are releasably connected to the target panel 12 to maintain the target panel 12 in an upright position.

For the purpose of withstanding the impact of the thrown projectile, the target panel 12 may be fabricated from a polymeric material, such as a molded plastic, which provides the target panel 12 with a substantially rigid characteristic. Although the target panel 12 may be described as rigid, the polymeric material provides a certain amount of flexibility so that the target panel 12 will not crack or break upon realizing the impact of the thrown projectile. The target panel 12 has a substantially rectangular configuration with a front side 20 and a back side 22. The front side 20 of the target panel 12 has a substantially smooth surface with a plurality of apertures 30 extending therethrough whereas the back side 22 of the target panel 12 has a lattice structure 24 having horizontal elements 26 and vertical elements 28. The intersection of the horizontal elements 26 and the vertical elements 28 of the lattice structure 24 define the apertures 30 that extend therethrough for receiving the bumpers 14 of the apparatus 10.

Figure 2:
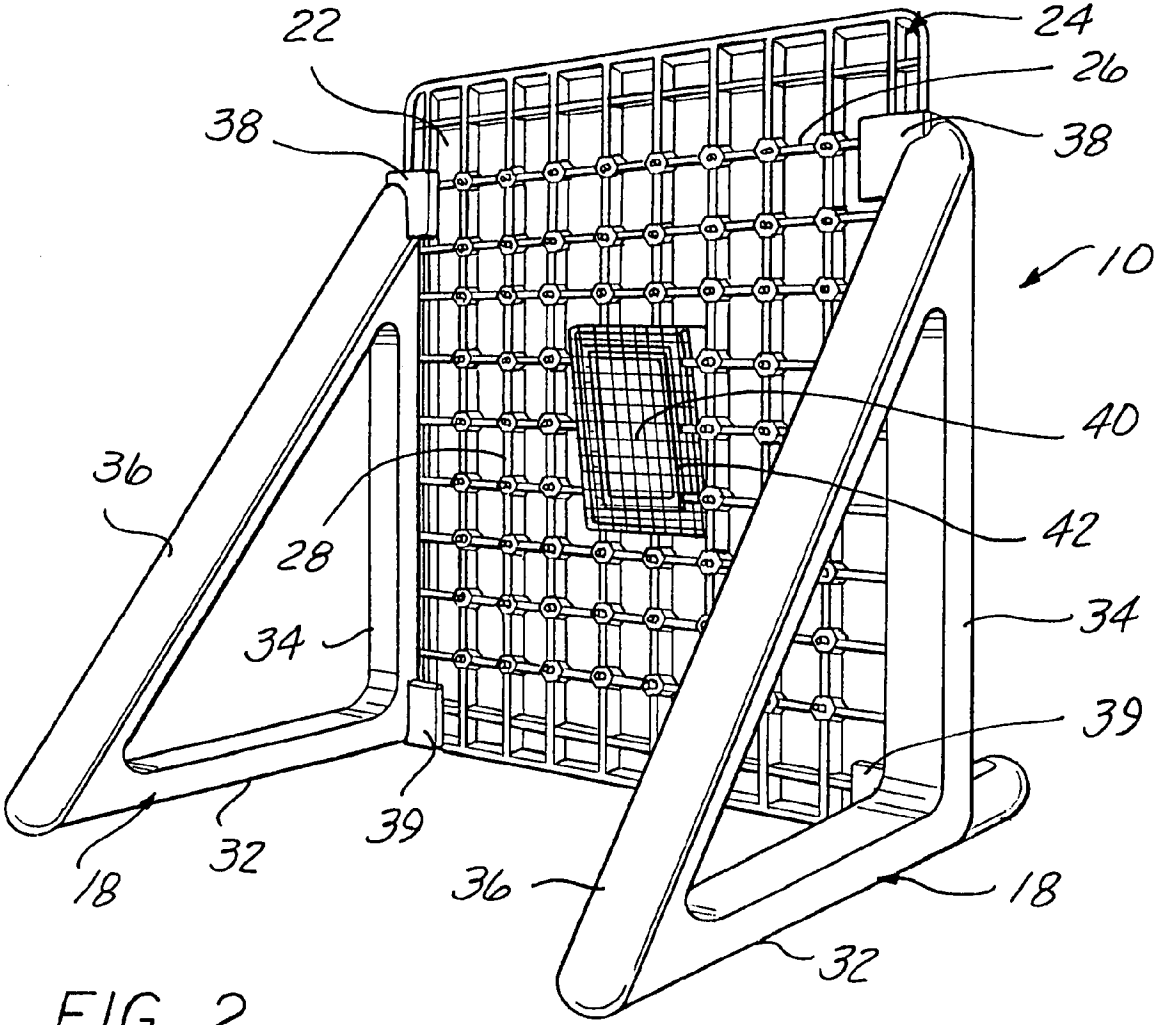
FIG. 2 is a perspective view showing the rear of the throwing and catching training apparatus of the present invention.
Figure 3:
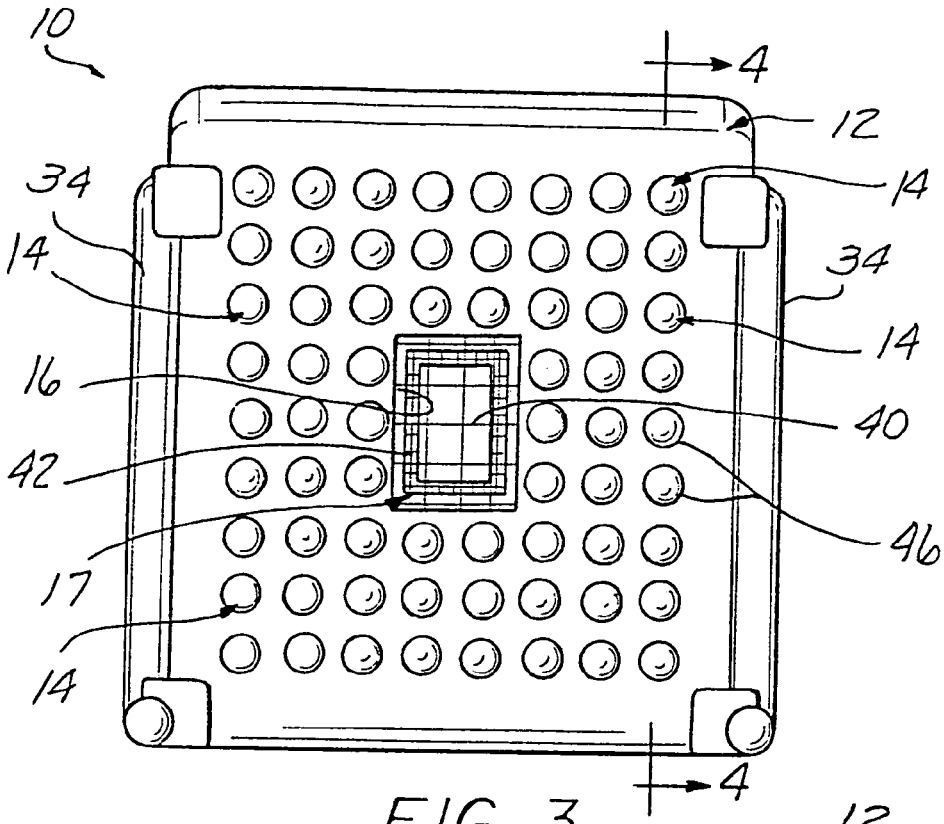
FIG. 3 is a front plan view of the throwing and catching training apparatus of the present invention.
Figure 4A:
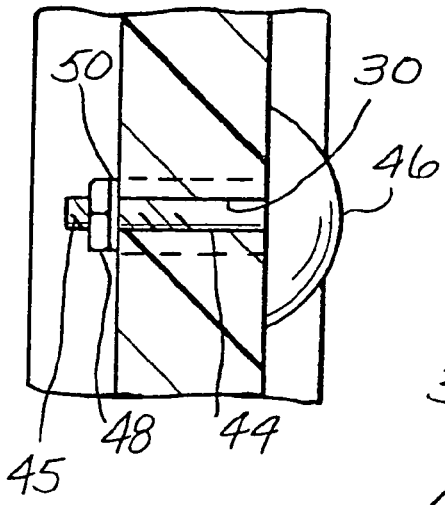
FIG. 4A is an enlarged detailed view of a portion of FIG. 4 showing the attachment of a single bumper in the throwing and catching training apparatus of the present invention.
Figure 4:
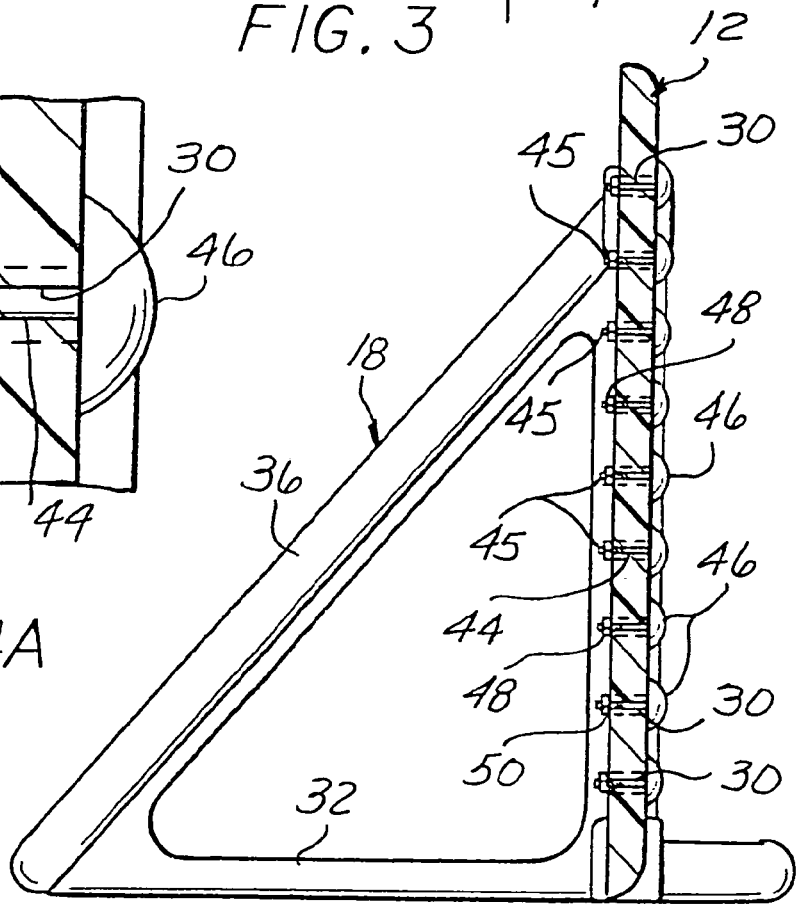
FIG. 4 is a sectional view of the throwing and catching training apparatus of the present invention in the direction of arrows 4—4 in FIG. 3.

To maintain the target panel 12 in an upright position, the support structures 18 are preferably mounted on opposite sides of the target panel 12. The support structures 18 are fabricated from a polymeric material, such as a molded plastic, thereby making the support structures 18 high strength, lightweight, and relatively inexpensive. Each of the support structures 18 has a substantially triangular configuration having a horizontal leg 32 that extends along the ground substantially perpendicular to the target panel 12, a vertical leg 34 that extends adjacent to a side of the target panel 12, and a cross member or angular leg 36 that extends at an angle between one end of the vertical leg 34 and one end of the horizontal leg 32. The horizontal leg 32, vertical leg 34, and the angular leg 36 are integrally molded to form a homogeneous support structure 18. FIGS. 1–3 show two support structures 18 mounted on opposite sides of the target panel 12.

It is contemplated that to releasably connect the target panel 12 to the support structures 18, an upper brace 38 and a lower brace 39 are integrally formed on each end of the vertical legs 34 of the support structures 18. The upper and lower braces 38, 39 each have a substantially U-shaped configuration wherein the opening of the U-shape opens to the target panel 12 so as to receive side portions of the target panel 12. A slide or snug fit is provided between each of the upper and lower braces 38, 39 and the target panel 12 such that the target panel 12 does not move upon being struck by the thrown projectile. The slide or snug fit also allows for the support structures 18 to be easily separated from the target panel 12 for easy assembly and disassembly of the apparatus 10.

To provide a target by which to throw the thrown projectile, the cut-out portion 16 of the target panel 12 has a substantially rectangular configuration. The elastomeric material 17 may include an elastic mesh netting 40 that is connected to the back side 22 of the target panel 12 by a conventional fastening means such that the elastic mesh netting 40 extends across the cut-out portion 16 of the target panel 12. The elastic mesh netting 40 is substantially taut so that the thrown projectile springs back upon engaging the elastic mesh netting 40 in the direction from which the projectile was thrown. A visual target indicia 42 may be included in the elastic mesh netting 40 by weaving a ribbon fabric through the elastic mesh netting 40 to form a substantially rectangular configuration. The visual target indicia 42 further defines a target by which to aim the thrown projectile. The visual target indicia 42 may provide a more accurate return of the thrown projectile if the thrown projectile engages the elastic mesh netting 40 within the area defined by the visual target indicia 42 since the elastic mesh netting 40 is more evenly supported by the target panel 12 within the visual target indicia 42 as opposed to outside the visual target indicia 42.

For the purpose of deflecting the thrown projectile in a random direction, the bumpers 14 are releasably connected to the target panel 12 in an equally spaced fashion. The bumpers 14 are vertically and horizontally aligned in columns and rows that are substantially perpendicular to one another and that correspond to the vertical elements 28 and the horizontal elements 26 of the lattice structure 24. The rows and columns of bumpers 14 form three concentric rectangles, wherein the cut-out portion 16 is substantially centered within the smallest of the three rectangles. Each bumper 14 includes a substantially cylindrical stem 44 having an integral substantially circular dome-shaped head 46 formed on one end of the stem 44, and a threaded shaft 45 extending from the opposite end of the stem 44. The threaded shaft 45 and a portion of the stem 44 are received by the apertures 30 provided in the intersection of the horizontal elements 26 and the vertical elements 28 of the lattice structure 24. The threaded shaft of the stem 44 extends beyond the lattice structure 24 that defines the apertures 30, and a nut 48 and a washer 50 are releasably threaded onto the threaded shaft until the nut 48 and washer 50 abut the lattice structure 24. The nut 48 and the washer 50 maintain the bumper 14 in a fixed position relative to the target panel 12 while also allowing the bumpers 14 to be removed and replaced with various sized bumpers if the user so desires. The bumpers 14 are fabricated from an elastomeric material, such as rubber, so that the thrown projectile will bounce off of the bumpers 14 and be deflected back to the user. In addition, the dome-shaped head 46 of the bumpers 14 is substantially hemispherical so that the thrown projectile will bounce back to the user in a random direction depending on what portion of the head 46 of the bumper 14 the thrown projectile engages and whether more than one bumper 14 is engaged by the thrown projectile. Various sized bumpers 14 may be utilized depending on the size of the thrown projectile utilized and depending on the random angularity of the deflection of the thrown projectile so desired.

In operation, the support structures 18 are connected to the target panel 12 by inserting the sides of the target panel 12 into the upper and lower braces 38, 39 of the support members 18. The support structures 18 maintain the target panel 12 in its upright position. A user faces the front side 20 of the target panel 12 at a desired distance and throws the projectile, such as a baseball or softball, at the target panel 12. If the elastic mesh netting 40 is hit by the thrown projectile, the thrown projectile will generally spring back to the user in the direction in which the projectile was thrown. If the thrown projectile engages the bumpers 14, the thrown projectile will deflect back at a random angle or direction to the user, thereby allowing the user to practice fielding the projectile.

While the invention has been described in connection with what is presently considered to be the most practical and preferred embodiment, it is to be understood that the invention is not to be limited to the disclosed embodiments, but to the contrary, it is intended to cover various modifications or equivalent arrangements included within the spirit and scope of the appended claims. The scope is to be accorded the broadest interpretation so as to encompass all such modifications and equivalent structures as is permitted under the law.

The invention claimed is:

1. A throwing and catching training apparatus, comprising:

an upright, rigid, and substantially planar target panel;

at least one bumper connected to said target panel, and said at least one bumper adaptable to deflect a thrown projectile in a random direction;

said target panel having a cut-out portion extending through said target panel for further defining a target; and an elastic material connected to said target panel and extending across said cut-out portion of said target panel, and said elastic material adaptable to spring a thrown projectile in a reverse direction when said thrown projectile engages said elastic material.

2. A throwing and catching training apparatus, comprising:

an upright, rigid target panel;

a plurality of elastomeric bumpers releasably connected to said target panel and adaptable to deflect a thrown projectile in a random direction;

said target panel having a cut-out portion extending through said target panel for further defining a first target; and an elastic mesh netting connected to said target panel and extending across said cut-out portion of said target panel and adaptable to spring a thrown projectile in a reverse direction when said thrown projectile engages said elastic mesh netting.

3. The throwing and catching training apparatus stated in claim 2, further comprising:

a visual target indicia connected to said elastic mesh netting for further defining a second target.

4. A throwing and catching training apparatus, comprising:

an upright, rigid target panel;

at least one support structure releasably connected to said target panel for supporting said target panel in a substantially upright position;

a plurality of elastomeric bumpers releasably connected to said target panel and adaptable to deflect a thrown projectile in a random direction; and wherein each of said bumpers further has a stem received by an aperture in said target panel, said stem having a threaded shaft wherein a releasable fastener engages said shaft to connect said bumper to said target panel, and a substantially circular, dome-shaped head integral with and extending from said stem, wherein said dome-shaped head extends away from said target panel and is adaptable to deflect the thrown projectile in a random direction.

5. A throwing and catching training apparatus, comprising:

an upright, rigid target panel;

at least one support structure releasably connected to said target panel for supporting said target panel in a substantially upright position;

a plurality of elastomeric bumpers releasably connected to said target panel and adaptable to deflect a thrown projectile in a random direction;

said target panel having a substantially rectangular cut-out portion extending through said target panel for further defining a target; and an elastic mesh netting connected to said target panel and extending across said cut-out portion and adaptable to spring a thrown projectile in a reverse direction when said thrown projectile engages said elastic mesh netting.

6. The throwing and catching training apparatus stated in claim 5, further comprising:

a ribbon fabric intertwined within said elastic mesh netting for further defining said target.

* * * * *